US008468955B2

(12) United States Patent
Durço

(10) Patent No.: US 8,468,955 B2
(45) Date of Patent: Jun. 25, 2013

(54) PALLET

(75) Inventor: José Roberto Durço, São Paulo (BR)

(73) Assignees: Rodinei Lapietra, Júnior, São Paulo (BR); José Roberto Durço, São Paulo (BR)

( * ) Notice: Subject to any disclaimer, the term of this patent is extended or adjusted under 35 U.S.C. 154(b) by 282 days.

(21) Appl. No.: 12/551,968

(22) Filed: Sep. 1, 2009

(65) Prior Publication Data

US 2010/0050910 A1 Mar. 4, 2010

Related U.S. Application Data

(63) Continuation-in-part of application No. PCT/BR2008/000053, filed on Feb. 27, 2008.

(30) Foreign Application Priority Data

Mar. 1, 2007 (BR) ..... 0700676

(51) Int. Cl.
*B65D 19/38* (2006.01)

(52) U.S. Cl.
USPC ..... 108/57.31; 108/57.17

(58) Field of Classification Search
USPC ..... 108/57.31, 57.29, 57.17, 57.22, 57.23, 108/57.25, 901, 51.3
See application file for complete search history.

(56) References Cited

U.S. PATENT DOCUMENTS 2,444,183 A * 6/1948 Cahners ..... 108/51.3
2,544,657 A 3/1951 Cushman
2,774,490 A * 12/1956 Strong ..... 206/598
3,036,802 A * 5/1962 Kitchell ..... 108/51.3
3,112,715 A * 12/1963 Callahan et al. ..... 108/51.3
3,797,727 A 3/1974 Downing et al.
4,296,860 A 10/1981 Hsu et al.
4,303,020 A * 12/1981 Houle ..... 108/51.3
4,445,614 A 5/1984 Mitsumori et al.
4,765,252 A 8/1988 Shuert
4,785,957 A 11/1988 Beck et al.
4,863,024 A * 9/1989 Booth ..... 108/51.3

(Continued)

FOREIGN PATENT DOCUMENTS

WO WO 03/037733 A1 5/2003

OTHER PUBLICATIONS

International Search Report and Written Opinion for International Application No. PCT/BR2008/000053; date of mailing Jun. 24, 2008.

(Continued)

*Primary Examiner* — Hanh V Tran
(74) *Attorney, Agent, or Firm* — Alston & Bird LLP

(57) ABSTRACT

A pallet for the storage and transport of various loads is provided. More particularly, the pallet includes a constructive configuration comprising a light, flexible and compression-resistant material. The pallet includes at least a load arrangement surface capable of accommodating the loads and a support element associated to the loads arrangement surface, the support element being capable of sustaining the loads. The pallet further includes a support element, which includes at least one kind of alveolar plastic and has a substantially dome-shaped crosswise section. The pallet also includes a fabric covering capable of externally enveloping both the loads arrangement surface and the support element.

16 Claims, 9 Drawing Sheets

U.S. PATENT DOCUMENTS

| | | | | | |
|---|---|---|---|---|---|
| 4,936,451 | A | | 6/1990 | Shuert | |
| 4,980,214 | A | | 12/1990 | Charriere | |
| 5,067,418 | A | * | 11/1991 | Carter | 108/56.3 |
| 5,377,600 | A | * | 1/1995 | Speese et al. | 108/51.3 |
| 5,465,672 | A | | 11/1995 | Boyse et al. | |
| 5,597,084 | A | | 1/1997 | Parasin | |
| 5,890,437 | A | * | 4/1999 | Hill | 108/51.3 |
| 5,921,187 | A | * | 7/1999 | Wang | 108/51.3 |
| 6,234,087 | B1 | | 5/2001 | Brown | |
| 6,533,121 | B1 | * | 3/2003 | Ross | 206/599 |
| 6,745,703 | B2 | | 6/2004 | Torrey et al. | |
| 6,758,148 | B2 | | 7/2004 | Torrey et al. | |
| 7,128,209 | B2 | | 10/2006 | Bringard et al. | |
| 7,516,706 | B2 | * | 4/2009 | Creighton et al. | 108/56.3 |
| 7,913,630 | B2 | * | 3/2011 | Creighton et al. | 108/56.3 |
| 2006/0254473 | A1 | | 11/2006 | Creighton et al. | |

OTHER PUBLICATIONS

Office Action dated Nov. 29, 2010 of related U.S. Appl. No. 12/615,347, filed Nov. 10, 2009.

Office Action dated Aug. 22, 2011 for U.S. Appl. No. 12/615,347, filed Nov. 10, 2009.

* cited by examiner

PALLET

CROSS REFERENCE TO RELATED APPLICATIONS

This application is a continuation-in-part of International Application No. PCT/BR2008/000053, filed Feb. 27, 2008, which designated the United States and was published by the International Bureau in English on Sep. 4, 2008, and claims priority from Brazilian Patent Application No. P10700676-4, filed Mar. 1, 2007, both which are hereby incorporated herein in their entirety by reference.

BACKGROUND OF THE INVENTION

1. Field of the Invention

The present invention refers to a pallet for the storage and transport of various loads. More particularly, the invention refers to a constructive configuration of a pallet comprising a light, flexible and compression-resistant material.

2. Description of Related Art

A pallet used for storage and transport of loads can be evaluated by its functionality, performance and quality, by means of the analysis of the parameters such as mechanical resistance and size, static and dynamic stability, among others. Such parameters must meet the requirements established in accordance with the user's needs, handling and movement, and this involves two basic questions: the raw materials and the constructivity used in the assembly and manufacture of the pallet. However, the cost involved in production is a restricting factor for the scope of the pallet design. Often, a functional, efficient and good quality pallet having all the desirable characteristics is costly and its production is considered unfeasible.

Evaluation Parameters

Mechanical resistance is one of the determining factors of the total admissible load of the pallets. Both the raw materials used and the constructive configuration directly affect this matter. A pallet with low mechanical resistance has a low admissible load capacity, and may buckle or even become damaged depending on the total weight placed thereon, thus jeopardizing the safety of the load(s).

Size stability is achieved by using easy to handle raw materials that have low sensitivity in relation to climactic changes such as temperature and humidity. The production process may correct any size discrepancies, but this action involves cost and often the cost of repeated work is high because both allocation of specialized manpower and time could be used in other production processes.

Static stability is particularly important in stacking the loads on the pallet and in stacking the pallets on top of one another when not in use. The constructive configuration of the pallets should allow for a maximum quantity of stacked loads without risking their sliding or instability due to any constructive defect in the pallet interface. Therefore, the interface should not only have a physical space to place the loads, but also offer stability and safety for the loads themselves. The same can be said of the stacking of the pallets. Currently, it is commonplace to stack unused pallets in order to streamline space or to use them for other production purposes. The structure should be such that the pallet does not damage an another pallet beneath it.

Dynamic stability is related to the matter of slipping or sliding of the forks of the forklift trucks when inserting them into the pallets. Many currently known pallets are not able to maintain perfectly stability on the forks, and this may give rise to sliding and consequently damage the loads when the trucks move the pallets. The design of the pallet must also take into consideration other types of movement in which the pallet is subject during the production process such as, for example, transport via a conveyor belt that moves horizontally and vertically. Both the constructive configuration and the material used influence the dynamic stability, and a material having low attrition (friction) facilitates sliding.

The parameters explained above directly influence the various processes involved in handling pallets such as palletization (separation of stacked pallets and placement of loads on pallets), unitization (grouping of various lesser load volumes into a single larger volume on the pallet) and export (transport, movement and unloading of the pallet).

Raw Materials

The choice of raw materials is a fundamental and determinant stage for the pallet design, and it can become a limiting factor upon the design scope depending on the needs and requirements. The performance of the constructive configuration directly depends on the material used and vice-versa.

Most currently known pallets are built of wood or injected plastic.

The wooden parts have a relatively low manufacturing cost and also are easy to produce and structurally sound. However, this material presents certain problems such as fragility to attack by pests such as termites and the need to use nails or threads, which may damage the load placed upon the pallet, in joining the parts. Another drawback involves the difficulty of size control of the wood, and this fact may prejudice process automation besides creating difficulties in storing the pallets when not in use.

Despite the low manufacturing cost, wooden pallets may be costly due to the need to carry out the fumigation process, especially for exporting pallets. Fumigation consists of applying chemical products on the wood to disinfect the pallet, eliminating pests such as termites. This process is time-consuming and also costly, and adds to the final cost of the pallet as well as to the cost of transporting goods.

Lastly, the final disadvantage of wooden pallets concerns sustainability and environmental preservation. The use of wood causes deforestation and negatively impacts the environment. Therefore, the sustainability requirements are compromised, and the natural resource will potentially be depleted or become scarce.

Injected plastic parts have good durability, inherent pest resistance, and require no nails because generally injected plastic pallets are made in a single unit. However, this material has drawbacks such as low friction (instability), difficulty in repairing and the high cost involved in the manufacture of an injection mold. Thus, the production cost increases the final price of the pallet and, in most cases, the high cost of production of a plastic pallet makes its use unfeasible.

In this backdrop, it can be said that until the present invention there was no a pallet that brings together all the desired requirements and functionality at low cost. The user was often obliged to opt for certain characteristics whilst renouncing others due to the limitations dictated by cost, material and constructivity of the pallet.

OBJECTS OF THE INVENTION

A first objective of the present invention is to propose a pallet configuration that meets the requirements of functionality presented above and have good performance, keeping the final cost relatively low.

The design and constructivity of the pallet subject matter of this present invention prioritized the use of low-cost materials that are easily obtained on the market. Due to the simplicity of the design, the production process to manufacture the pallet is easy to implement and does not require costly apparatus (equipment, machines and tools) and specialized labor. Therefore, these factors ensure low final cost compared to other types of pallets currently known in the art. Additionally, for the reasons set forth above, pallet maintenance and repairs as may be needed are also made easy.

Accordingly, a new constructive configuration and material for the pallet were developed with the objective of obtaining a relatively low cost without comprising the desirable functional and performance requirements for storage and transport of the pallet.

A second objective of the present invention is to provide a pallet having all the features mentioned above and enabling the transport operations in four portions (forward, back, left side and right side), turning the operation of the forklift easy.

A third object of the present invention is to provide a pallet, having all the features mentioned above, which avoids a support structure or platform, keeping plane even in the case of transporting very heavy loads, due to its inherent geometrical configuration.

A fourth objective of the present invention is to provide a pallet, having all the characteristics mentioned above, which presents low manufacturing costs.

A fifth objective of the present invention is to provide a pallet, having all the characteristics mentioned above, which when used to transport raw material in the form of plastic resin, can be melted together with the resin it previously transported, enabling its recycling procedure without incurring further expenses.

BRIEF DESCRIPTION OF THE INVENTION

The objective of the present invention is achieved by a pallet used for storage and transport of loads comprising at least:

a loads arrangement surface capable of accommodating said loads and two support elements associated to the loads arrangement surface and capable of sustaining said loads, said support elements being positioned substantially parallel therebetween and capable of supporting loads, each support element being provided with a substantially cross section of a circular dome-shaped kind and having an upper limit and a lower limit, the loads arrangement surface being positioned in some place between the upper and lower limits of the support elements, the surface being positioned nearer of the upper limit than of the lower limits.

BRIEF DESCRIPTION OF THE DRAWINGS

The present invention will now be described in greater detail, with reference to the drawings appended hereto, wherein.

DETAILED DESCRIPTION OF THE DRAWINGS

Figure 1:
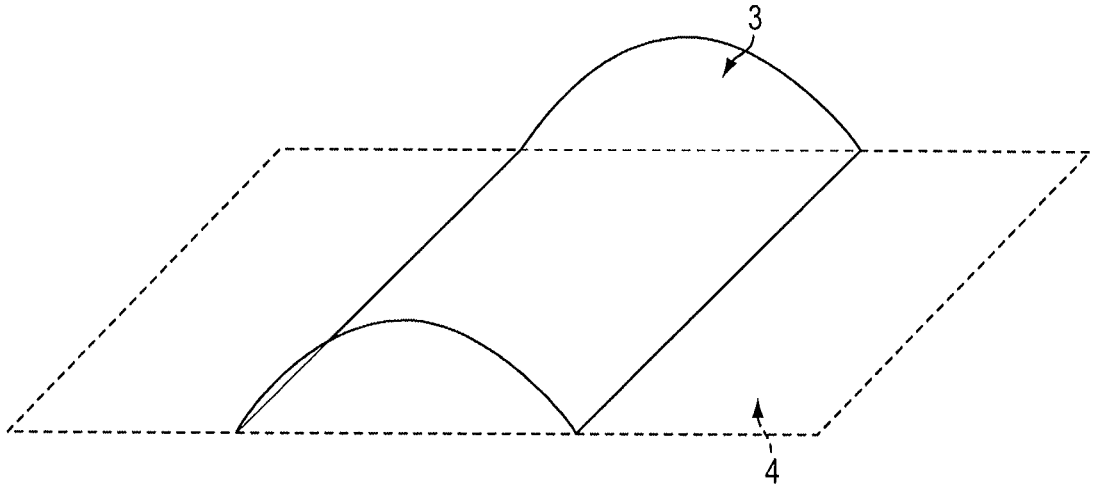
FIG. 1—represents a perspective view of the support element of the pallet sustained on any surface.

Some examples of preferred embodiments for the pallet 1 subject matter of the present invention are presented below. In all the examples, the pallet 1 comprises a load arrangement surface 2 sustained on two or more support elements 3. Preferably, three support elements 3 are used; however, this number may be altered in accordance with the desired functional need and requirements.

The loads arrangement surface 2 has a fabric covering and is capable of accommodating any type of load provided that the total weight limit is respected and provided the load does not damage it. The fabric covering extends to the support elements 3, enveloping them, and they are held together by simple sewing. Other types of join are possible, such as, for example, special glue or soldering. Preferably, a fabric comprising raffia is used. Raffia is a low cost material made of synthetic fibers transformed from polypropylene. Its main characteristics include high mechanical resistance, good size stability (easy to mold), facility to clean and high thermal stability, in addition to providing sufficient attrition to stabilize the load placed on the pallet 1 without sliding. Another kind of natural, synthetic or artificial fabric can be used as long as its characteristics do not compromise the functionality and safety requirements achieved when using raffia.

The loads arrangement surface 2 comprises four ends: a first end 201, a second end 202, a third end 203 and a fourth end 204. The first end 201 and the second end 202 are arranged in parallel to one another at opposite ends to the surface 2 and the third end 203 and the fourth end 204 are arranged in parallel to one another at opposite ends to the surface 2 and intersecting with the first and second ends 201, 202. The pallet 1 also comprises a base 5 that is capable of providing support for pallet 1 on an external means, which is formed by the extension of the fabric covering of the loads arrangement surface 2. Said external means can be represented by any external surface or by the loads arrangement surface itself of another pallet 1, when these are not in use and are stacked vertically. Accordingly, pallet sliding can be avoided by, for example, a conveyor belt, due to the friction provided by the raffia, thus improving the dynamic stability.

The support element 3, which is supported on an outer surface 4 (FIG. 1), has a three-dimensional geometrical shape and is made of a light, flexible and compression-resistant material. Preferably, this material comprises an alveolar type plastic such as, for example, Polyonda®. The alveolar structure is characterized by a double-layered physical arrangement capable of sustaining weights and movements of all kinds of loads. Polyonda® is a thermoplastic and comprises other characteristics such as high thermal resistance and impermeability. Evidently, another kind of material can be used as long as the functionality and safety requirements provided by alveolar plastic are maintained. Further, alveolar plastic can be used in conjunction with any other material such as cardboard or some other kind of plastic.

Preferably, the cross section of the support element 3 is of a circular dome-shaped kind, which provides good support and safety for the load(s) placed on the loads arrangement surface 2. This type of configuration, working together with the alveolar plastic, has good mechanical resistance and, consequently, good total admissible load capacity. Moreover, the support elements 3 are configured such as to allow stable contact with the forks of the fork-life truck, preventing the pallet 1 from slipping when said forks are inserted and during load movement and transport by the fork-lift trucks. Accordingly, good dynamic stability is achieved. In some preferred embodiments, illustrated in FIGS. 2 to 11, the convex section of the dome-shaped support element 3 faces the loads arrangement surface 2 and the concave section of the dome-shaped support element 3 faces the base 5. Yet this dome-shaped geometric format is not the only possible solution, and other variations are permitted, both in the geometric shape as in the constructive configuration. Therefore, the support element 3 may have the three-dimensional shape of a triangular dome, a parallelepiped or even irregular geometric shapes, provided that the pallet 1 has the intended safety and reliability.

The longitudinal section of the support element 3 extends from the perpendicular projection of the third end 203 to the perpendicular projection of the fourth end 204 to provide uniform and homogeneous support for the entire area comprised by the loads arrangement surface 2.

The fabric covering merely extends through the perpendicular projections of the first and second ends 201, 202, and, preferably, the apertures of the support elements 3 are not enveloped by the fabric covering. Thus, the support elements 3 also act as guides for the forks of the forklift trucks, facilitating transport operations by the operator.

The raw materials used (fabric and alveolar plastic) facilitate the desired size stability, because these materials are easy to handle. So, if there is any discrepancy with the originally designed sizes, no special tools or specialized manpower is required to carry out the repeat work and, even if does generate material wastage, the damage would be much less compared to conventional raw materials. Besides these and other functional advantages explained previously, the raw materials used are recyclable, that is, the fabric and the alveolar plastic can be reused to manufacture other pallets or even other products for other uses. Therefore, the negative environmental impact is reduced, whilst achieving a sustainable yield.

Some examples of variations of the pallet 1 are presented bellow.

First Embodiment

Figure 2:
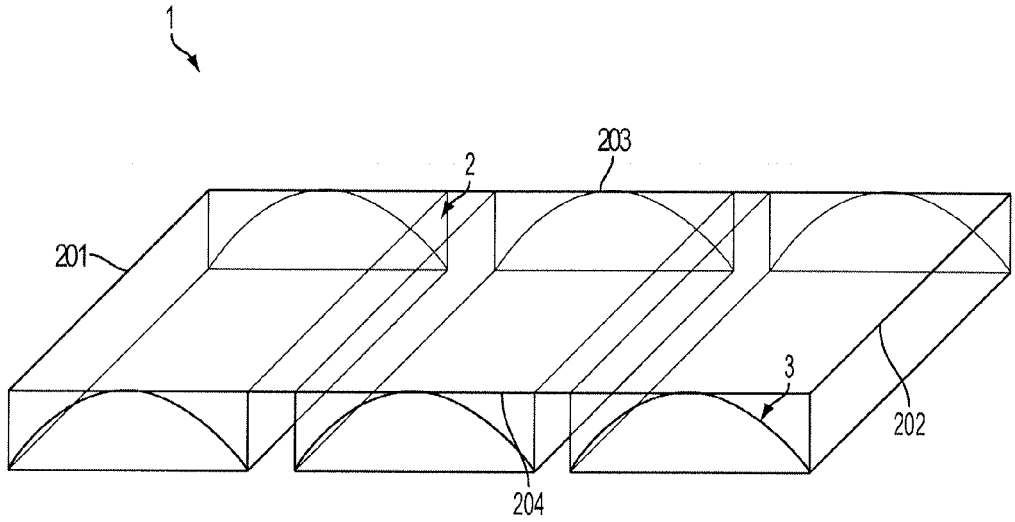
FIG. 2—represents a perspective view of a first embodiment of the pallet object of the present invention.
Figure 3:
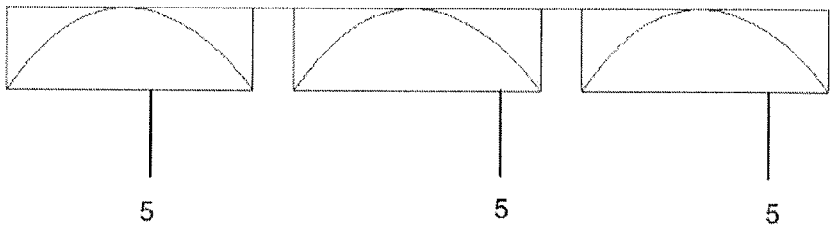
FIG. 3—represents a front view of the pallet illustrated in FIG. 2.

The first embodiment for the pallet 1 is illustrated in FIGS. 2 and 3. Each of the three support elements 3 are externally and individually enveloped by the extension of the fabric covering of the loads arrangement surface 2. In this embodiment, the loads arrangement surface 2 only comprises the fabric covering which, in turn, comprises the raffia. This is one of the preferred embodiments.

Second Embodiment

Figure 4:
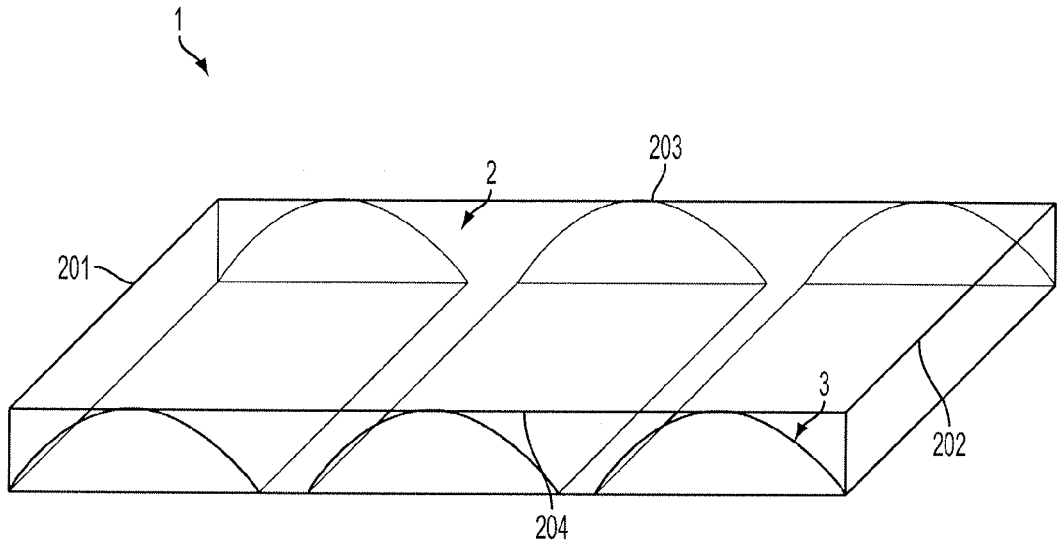
FIG. 4—represents a perspective view of a second embodiment of the pallet object of the present invention.
Figure 5:
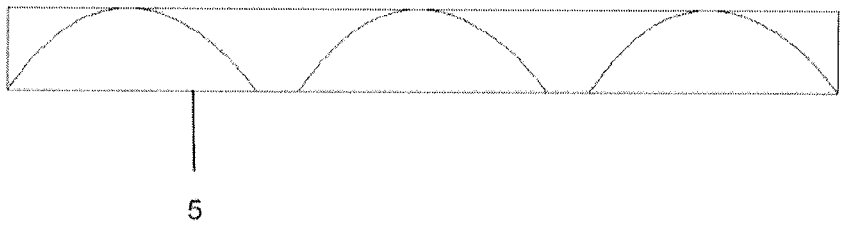
FIG. 5—represents a front view of the pallet illustrated in FIG. 4.

The second embodiment for the pallet 1 is illustrated by FIGS. 4 and 5. The three support elements 3 are externally and jointly enveloped by the extension of the fabric of the loads arrangement surface 2. Thus, the fabric covering envelops the entire structure of the pallet 1, providing greater stability and safety, but with a greater fabric consumption compared to the first embodiment.

Third Embodiment

Figure 6:
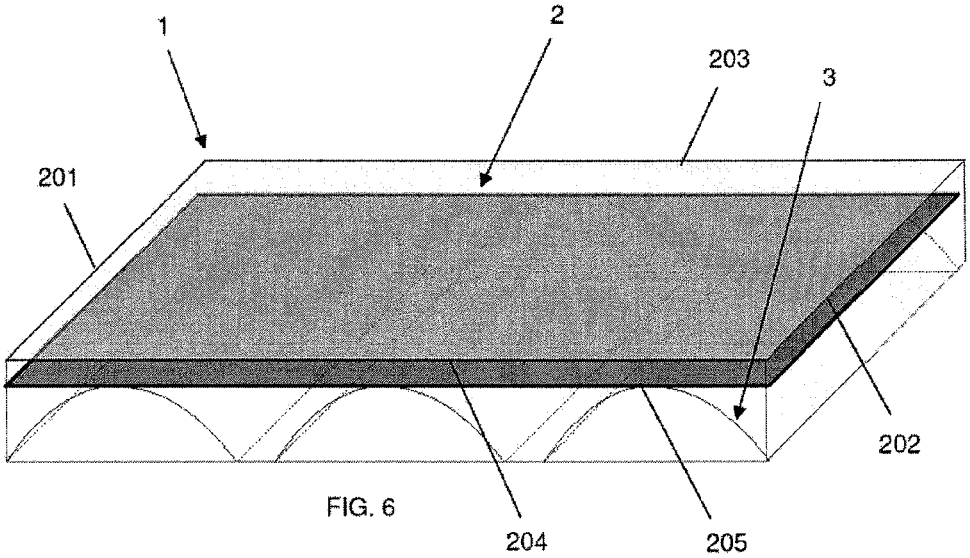
FIG. 6—represents a perspective view of a third embodiment of the pallet object of the present invention.
Figure 7:
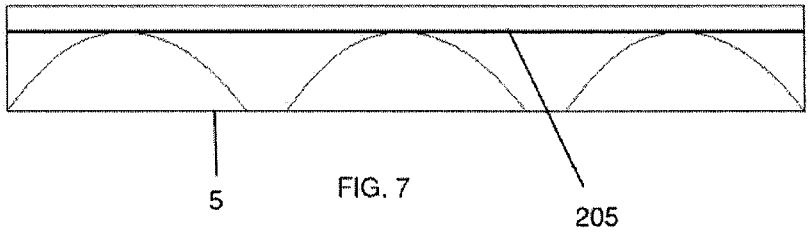
FIG. 7—represents a front view of the pallet illustrated in FIG. 6.

The third embodiment for the pallet 1 is illustrated by FIGS. 6 and 7. The loads arrangement surface 2 comprises a substantially rigid sustainment platform 205 in addition to the fabric covering. The sustainment platform 205 is rectangular in shape and encompasses the entire area of the loads arrangement surface 2.

The raw materials used to manufacture this sustainment platform 205 should have rigidity and thickness in accordance with the use requirements. Thus, cardboard, alveolar plastic itself or any kind of material that meets the needs can be used.

The sustainment platform 205 is positioned between the support elements 3 and the fabric covering of the loads arrangement surface 2, in such a way that the loads are sustained on the support elements 3, and the fabric covering is sewn thereon to avoid slipping on the support elements 3.

Fourth Embodiment

Figure 8:
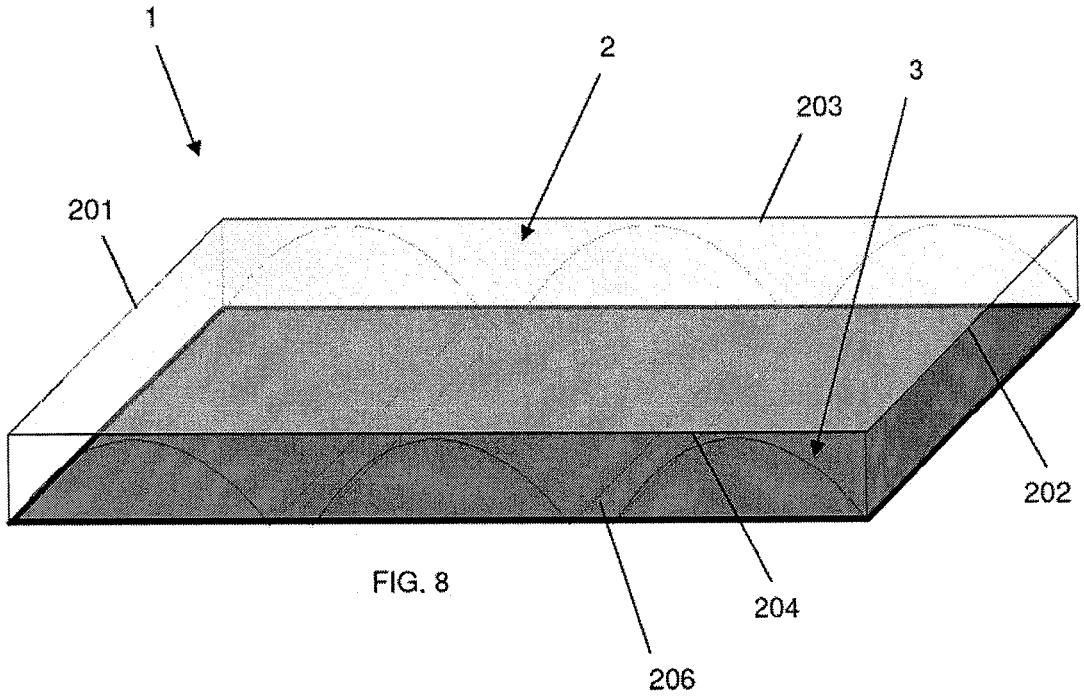
FIG. 8—represents a perspective view of a fourth embodiment of the pallet object of the present invention.
Figure 9:
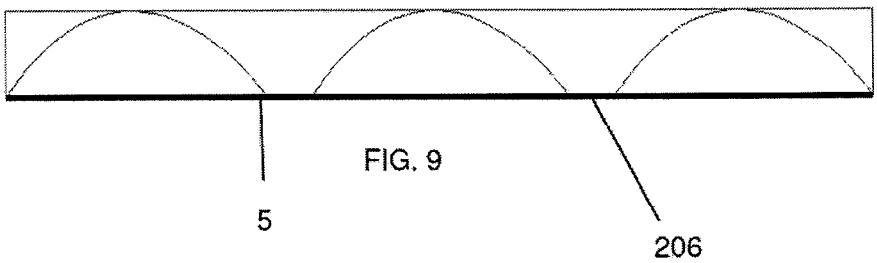
FIG. 9—represents a front view of the pallet illustrated in FIG. 8.

The fourth embodiment for the pallet 1 is illustrated by FIGS. 8 and 9. In this configuration, the support platform 206 is placed between the support elements 3 and the fabric covering of the base 5 of the pallet 1. The support platform 206 is rectangular in shape and encompasses the entire area projected perpendicularly from the loads arrangement surface 2. The extension of the fabric covering of the loads arrangement surface 2 is sewn on the support platform 206.

As regards the raw materials, the same observations made for the sustainment platform 205 can be applied to the support platform 206.

The support sustainment 205 of the third embodiment and the support platform 206 of the fourth embodiment can be implemented together in another embodiment, thus increasing the mechanical resistance and static stability of the pallet 1.

Fifth Embodiment

Figure 10:
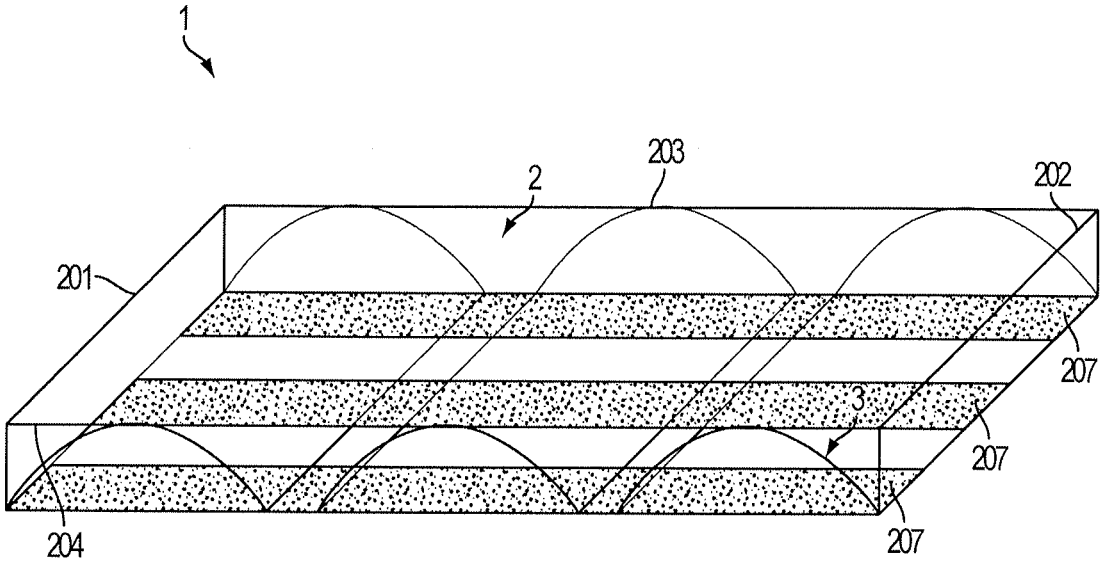
FIG. 10—represents a perspective view of a fifth embodiment of the pallet object of the present invention.
Figure 11:
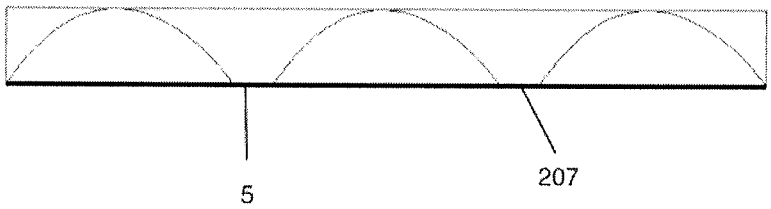
FIG. 11—represents a front view of the pallet illustrated in FIG. 10.

The fifth embodiment for the pallet 1 is illustrated by FIGS. 10 and 11. This constructive configuration is similar to the fourth embodiment, but instead of a support platform 206, there are three support platforms 207 also rectangular in shape, but smaller in width. Thus, two or more support platforms 207 can be extended like a frame which extends from the perpendicular projection of the first end 201 to the perpendicular projection of the second end 202 of the pallet 1. As in the fourth embodiment, the extension of the fabric covering of the loads arrangement surface 2 is sewn to the support platforms 206.

Having described some examples of preferred embodiments, it must be understood that the scope of the present invention encompasses other possible variations, and is only limited by the content of the claims appended hereto, which include possible equivalents.

Sixth Embodiment

Figure 12:
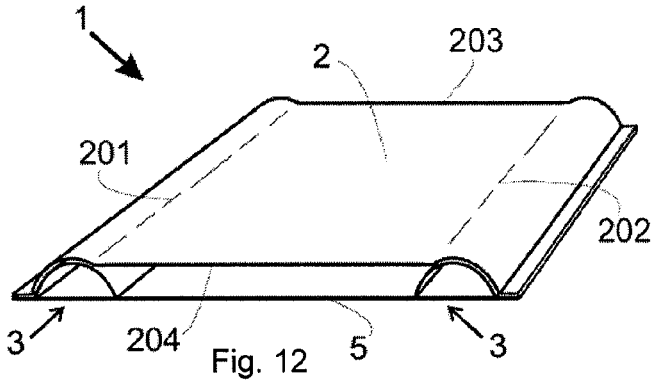
FIG. 12—represents a perspective view of a sixth embodiment of the pallet object of the present invention.
Figure 13:
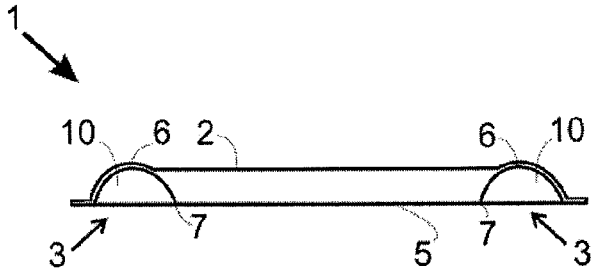
FIG. 13—represents a front view of the pallet illustrated in FIG. 12.
Figure 14:
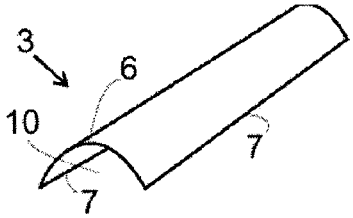
FIG. 14—is a perspective view of the support element of the pallet illustrated in FIG. 12.
Figure 15:
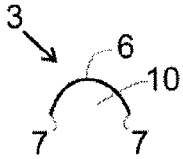
FIG. 15—is a front view of the support element illustrated in FIG. 14.

The sixth embodiment of the present invention is illustrated in FIGS. 12 and 13 and comprises at least two support elements 3 capable of sustaining loads. Each support element 3 is provided with a cross section is of a substantially circular dome-shaped kind having at least an upper limit 6 and a lower limit 7. The dome-shaped constitution and the alveolar structure confer a mechanic resistance enabling the support element 3 to support static load of around 6,000 kg, despite the fact that it weights only 2.7 kg. It thus presents low manufacturing costs and a very high performance in supporting loads, in opposition to other known geometrically formed support elements, which show worse results in term of mass x load capacity ratio.

As a matter of comparison, a wood pallet weights 28 kg, hardening the procedures for its transporting (it is hard for a man alone to carry one, for example).

In this embodiment, considering that preferably the cross section is substantially circular dome-shaped (similar to an arc), the upper limit 6 is the point of inflexion of the arc, representing its upper point. On the other hand, the lower limits 7 consist in any point(s) of the base of the arc, representing the lower points of said arc.

Specifically, the loads arrangement surface 2, associated to the support elements 3, is disposed in some place between the upper and lower limits 6,7 of the support elements 3. The surface 2 must be positioned nearer of the upper limit 6 than of the lower limits 7, enabling a load area substantially plan and stable for positioning loads.

In other words, the assembly composed of the support elements 3 and the loads arrangement surface 2 creates a portion for positioning loads substantially plan and having an increased area, without deforming easily, even in the case of absence of a support platform.

It is important to note that the surface 2 is not positioned to match the upper limits 6, since this solution enables the undesirable deformation of the surface 2 under medium to high loads.

This embodiment also comprises at least a base 5 associating the lower limits 7 of the support elements 3 therebetween in order to increase the resistance and stability of the pallet.

Seventh Embodiment

Figure 17:
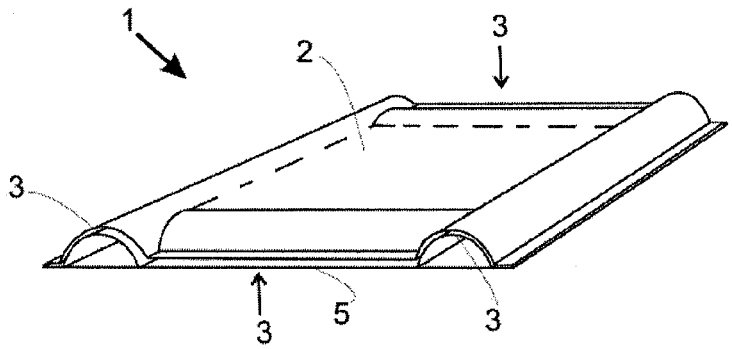
FIG. 17—represents a perspective view of a seventh embodiment of the pallet object of the present invention.
Figure 18:
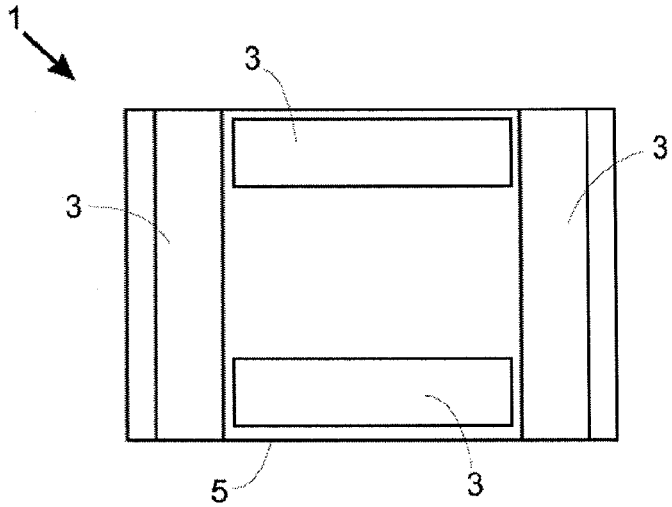
FIG. 18—represents an upper view of the pallet illustrated in FIG. 17, without the surface for receiving load.

The seventh embodiment of the present invention is illustrated in FIGS. 17 and 18 and comprises two additional support elements 3 positioned substantially parallel therebetween and substantially perpendicular with respect to the other two support elements 3. Hence, this embodiment has four support elements 3, a first support positioned at the first end 201 of the pallet, a second support 3 positioned at the second end 202, a third support 3 positioned at the third end 203 and a fourth support 3 positioned at the fourth end 204. This pallet has a quadrilateral reinforced shape which enables the support of heavy loads with stability and small deformation of the base 2.

Eighth Embodiment

Figure 19:
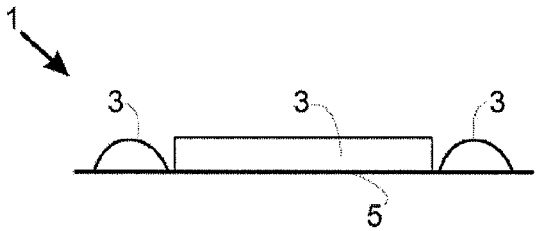
FIG. 19—represents a front view of the pallet illustrated in FIG. 17, without the surface for receiving load.
Figure 20:
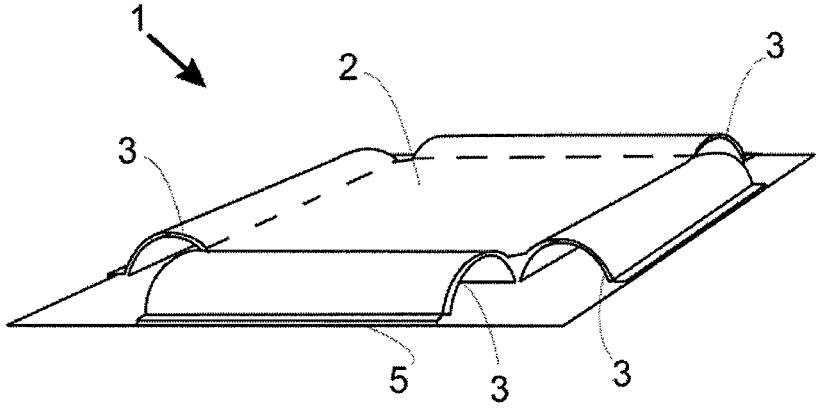
FIG. 20—represents a perspective view of an eighth embodiment of the pallet object of the present invention.
Figure 21:
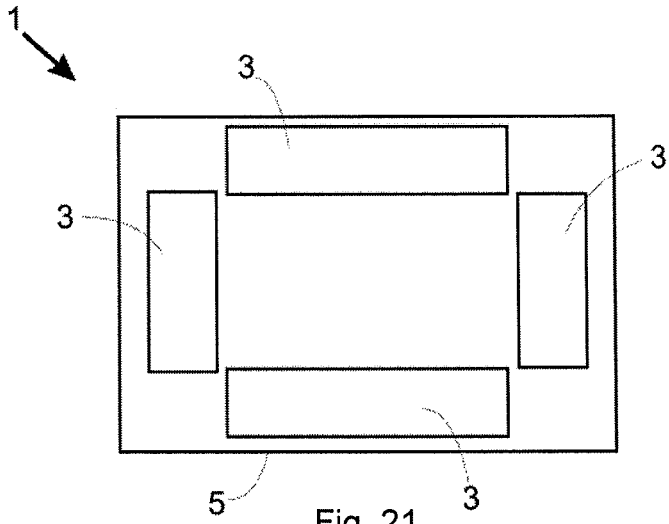
FIG. 21—represents an upper view of the pallet illustrated in FIG. 19, without the surface for receiving load.
Figure 22:
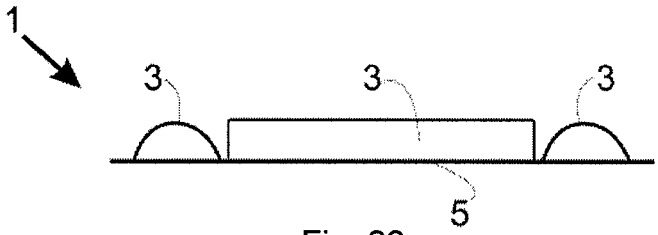
FIG. 22—represents a front view of the pallet illustrated in FIG. 19, without the surface for receiving load.

The eighth embodiment of the present invention is illustrated in FIGS. 19 to 21 and, considering that preferably the cross section is substantially circular dome-shaped (similar to an arc), the upper limit 6 is the point of inflexion of the arc, representing its upper point. On the other hand, the lower limits 7 consist in any point(s) of the base of the arc, representing the lower points of said arc.

Specifically, the loads arrangement surface 2, associated to the support elements 3, is disposed in some place between the upper and lower limits 6,7 of the support elements 3. The surface 2 must be positioned nearest of the upper limit 6 than of the lower limits 7, enabling a load area substantially plan and stable for positioning loads.

In other words, the assembly composed of the support elements 3 and the loads arrangement surface 2 creates a portion for positioning loads substantially plan and having an increased area, without deforming easily, even in the case of absence of a support platform.

It is important to note that the surface 2 is not positioned to match the upper limits 6, since this solution enables the undesirable deformation of the surface 2 under medium to high loads.

This embodiment also comprises at least a base 5 associating the lower limits 7 of the support elements 3 therebetween in order to increase the resistance and stability of the pallet.

The pallet comprises two additional support elements 3 positioned substantially parallel therebetween and substantially perpendicular with respect to the other two support elements 3. Hence, this embodiment has four support elements 3, a first support positioned at the first end 201 of the pallet, a second support 3 positioned at the second end 202, a third support 3 positioned at the third end 203 and a fourth support 3 positioned at the fourth end 204. This pallet has a quadrilateral reinforced shape which enables the support of heavy loads with stability and small deformation of the base 2.

And comprises four support elements 3 positioned in a manner that they show a length smaller that the length of the corresponding first, second, third and fourth end 201,202, 203,204. As a result, both openings 10 of all supports 3 are free and open to allow the positioning of a fork of the forklift. Hence, the pallet can be transported by any of the first to fourth ends, increasing its convenience.

Figure 16:
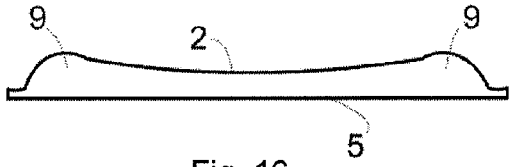
FIG. 16—is a front view of a surface for receiving loads and a base of the pallet illustrated in FIG. 12.

It is important to note that, in any embodiment of the pallet from sixth to eighth, the surface 2 and the base 5 are directly associated in order to form a single piece to involve externally the supports 3. FIG. 16 shows the surface 2 and a base 5 in one single piece according to the sixth embodiment of the present invention. Here, the single piece is previously assembled and ready to receive the support elements 3 by means of bags 9, simplifying the manufacture of the pallet 1.

Additionally, due to the high planarity of the load surface 2, even when supporting high loads, any embodiment of the pallet from sixth to eighth can be used (and loaded) upside down, that is to say, the surface 2 and the base 5 can be inverted, increasing the possibility of use. This use is not possible in the case of embodiments one to four of the present pallet.

Another important advantage of the pallet object of the present invention is that, when used to transport raw material in the form of plastic resin or the like, the pallet 1 can be melted together with the resin it previously transported. In this situation, the pallet can be advantageously manufactured with the same resin it will transport and it will perform an "one way trip" until the company where the resin (and the pallet) will be melted for the manufacturing of polymeric goods. Considering this, the pallet object of the present invention is if fact part of the raw material to be transported and hence its cost will be null. Another advantage is that the costs with the recycling of the pallet are null.

In other situation, the pallet object of the present invention can be used in complementation with the use of the already known pallets, with advantageous results regarding costs. Here, the conventional pallet (for example, the pallet manufactured with wood) is used internally in a first company (i.e. an industry), and the goods produced are transported with the pallet 1 object of the present invention. In this situation, the first company can spent more resources buying expensive pallets for internal use (to transport goods within its factory), and buy the cheap pallet 1 object of the present invention for the goods to be transport for example to a second company. While the goods are being transported within the factory of the first company, the pallet 1 object of the present inventions, loaded, is positioned, and transported, over the regular pallet, and the assembly is transported. The regular pallet acts as a base of the pallet 1 object of the present invention, being solely a device for internal use. Hence, the regular pallet does not leave the factory, avoiding costs for acquisition of others or the expensive costs for transporting them back.

Another advantage in the use of the pallet 1 object of the present invention during the transport between two companies is that there is an increase in the available space o truck, ships or whatever, since its height is at least 16 centimeters inferior to the height to a conventional pallet. In case of the positioning of several pallets one over the other, this mean a high increase in available space.

Having described some examples of preferred embodiments, it must be understood that the scope of the present invention encompasses other possible variations, and is only limited by the content of the claims appended hereto, which include possible equivalents.

That which is claimed:

1. A pallet used for storage and transport of loads comprising:

a substantially planar loads arrangement surface capable of accommodating said loads, said loads arrangement surface comprising a single-piece fabric covering; and two support elements associated with said loads arrangement surface and capable of sustaining said loads, said support elements being positioned substantially parallel there-between and capable of supporting loads, each support element having a first end and a second end, said first and second ends defining a length there-between, each support element further being provided with a cross section of a substantially circular dome-shaped kind and having an upper limit and a lower limit, the upper limit of each of the two support elements being coplanar with the substantially planar loads arrangement surface, and each support element being provided with at least one extremity having an opening to allow the positioning of a fork of a forklift;

wherein:

at least one portion of the single-piece fabric covering of the loads arrangement surface defines at least two cavities, such that an entirety of each of the two support elements, apart from the at least one extremity of each support element, is positioned within each of the at least two cavities, such that each of the support elements is externally and individually enveloped by the at least one portion of the single-piece fabric covering;

said loads arrangement surface comprises a first edge, a second edge, a third edge, and a fourth edge, said first and said second edges each having a length and being arranged in parallel to one another at opposite edges of said surface, said third and said fourth edges each having a length and being arranged in parallel to one another and perpendicular to said first and said second edges, at least one of said two support elements being positioned substantially adjacent and parallel to said first edge and at least one of said two support elements being positioned substantially adjacent and parallel to said second edge; and the length between said first end and said second end of each of said two support elements is less than said length of said first and said second edges of said loads arrangement surface, such that said first and said second ends of said two support elements are at least partially inset relative to said third and said fourth edges of said loads arrangement surface.

2. A pallet according to claim 1, further comprising a base associating the lower limits of the support elements therebetween.

3. A pallet according to claim 1, further comprising at least one support element positioned substantially adjacent and parallel to the third edge and at least one support element positioned substantially adjacent and parallel to the fourth edge.

4. A pallet according to claim 3, wherein each of the support elements positioned substantially adjacent and parallel the third and fourth edges have a length smaller than the length of the corresponding first and second, third and fourth edges and the at least one extremity comprises at least two extremities having openings to allow the positioning of a fork of a forklift.

5. A pallet according to claim 2, wherein:

the loads arrangement surface and the base are directly associated in order to form a single piece;

each of the support elements are formed separately from the single piece; and the single piece is configured to receive each of the support elements.

6. A pallet according to claim 1, each of the support elements comprises a light, flexible and compression-resistant material.

7. A pallet according to claim 6, wherein the light, flexible and compression-resistant material is an alveolar plastic.

8. A pallet according to claim 1, wherein the fabric covering of the loads arrangement surface comprises raffia.

9. A pallet according to claim 1, wherein the loads arrangement surface is sustained on each of the support elements.

10. A pallet according to claim 1, wherein at least a portion of the fabric covering of the loads arrangement surface is sewn to each of the support elements.

11. A pallet according to claim 1, wherein the the third edge and the fourth edge are arranged intersecting with the first and second edges.

12. A pallet according to claim 3, wherein at least one of the support elements positioned substantially adjacent and parallel to the third or fourth edges, and has a longitudinal section which extends substantially the length of the third or fourth edges.

13. A pallet according to claim 1, further comprising a support platform arranged between the support elements and the fabric covering of the base of the pallet.

14. A pallet according to claim 13, wherein at least a portion of the fabric covering of the loads arrangement surface is sewn to the support platform.

15. A pallet used for storage and transport of loads, the pallet comprising:

a substantially planar loads arrangement surface capable of accommodating said loads, said loads arrangement surface comprising a single-piece fabric covering, at least one portion of the single-piece fabric covering being configured to define at least two cavities; and two support elements associated to said loads arrangement surface and capable of sustaining said loads, said support elements being positioned substantially parallel there-between and capable of supporting loads, each support element having a first end and a second end, said first and second ends defining a length there-between, each support element further being provided with a cross section of a substantially circular dome-shaped kind and having an upper limit and a lower limit, the upper limit being coplanar with the substantially planar loads arrangement surface, each support element having an opening to allow the positioning of a fork of a forklift;

wherein:

the two support elements are positioned, respectively, within each of the at least two cavities, such that each of the two support elements is externally and individually enveloped by the at least one portion of the single-piece fabric covering of the loads arrangement surface;

at least a portion of the single-piece fabric covering is sewn to each of the support elements;

said loads arrangement surface comprises a first edge, a second edge, a third edge, and a fourth edge, said first and said second edges each having a length and being arranged in parallel to one another at opposite edges of said surface, said third and said fourth edges each having a length and being arranged in parallel to one another and perpendicular to said first and said second edges, at least one of said two support elements being positioned substantially adjacent and parallel to said first edge and at least one of said two support elements being positioned substantially adjacent and parallel to said second edge; and the length between said first end and said second end of each of said two support elements is less than said length of said first and said second edges of said loads arrangement surface, such that said first and said second ends said two support elements are at least partially inset relative to said third and said fourth edges of said loads arrangement surface.

16. A pallet used for storage and transport of loads comprising:

a substantially planar loads arrangement surface capable of accommodating said loads, said loads arrangement surface comprising a single-piece fabric covering; and two support elements associated with said loads arrangement surface and capable of sustaining said loads, said support elements being positioned substantially parallel there-between and capable of supporting loads, each support element having a first end and a second end, said first and second ends defining a length there-between, each support element further being provided with a cross section of a substantially circular dome-shaped kind and having an upper limit and a lower limit, the upper limit of each of the two support elements being coplanar with the substantially planar loads arrangement surface, and each support element being provided with at least one extremity having an opening to allow the positioning of a fork of a forklift;

wherein:

at least one portion of the single-piece fabric covering of the loads arrangement surface defines at least two cavities, such that an entirety of each of the two support elements, apart from the at least one extremity of each support element, is positioned within each of the at least two cavities, such that each of the support elements is externally and individually enveloped by the at least one portion of the single-piece fabric covering;

said loads arrangement surface comprises a first edge, a second edge, a third edge, and a fourth edge, said first and said second edges each having a length and being arranged in parallel to one another at opposite edges of said surface, said third and said fourth edges each having a length and being arranged in parallel to one another and perpendicular to said first and said second edges, at least one of said two support elements being positioned substantially adjacent and parallel to said first edge and at least one of said two support elements being positioned substantially adjacent and parallel to said second edge;

the length between said first end and said second end of each of said two support elements is less than said length of said first and said second edges of said loads arrangement surface, such that said first and said second ends said two support elements are at least partially inset relative to said third and said fourth edges of said loads arrangement surface; and said pallet further comprises a base associating the lower limits of the support elements there-between.

* * * * *

UNITED STATES PATENT AND TRADEMARK OFFICE

CERTIFICATE OF CORRECTION

PATENT NO. : 8,468,955 B2
APPLICATION NO. : 12/551968
DATED : June 25, 2013
INVENTOR(S) : Durço It is certified that error appears in the above-identified patent and that said Letters Patent is hereby corrected as shown below:

Title Page

"(73) Assignees: Rodinei Lapietra, Júnior, São Paulo (BR); José Roberto Durço, São Paulo (BR)" should read --(73) Assignees: Rodinei Lapietra Júnior, São Paulo (BR); José Roberto Durço, São Paulo (BR)--

Signed and Sealed this
Tenth Day of September, 2013

Teresa Stanek Rea
*Acting Director of the United States Patent and Trademark Office*